US007384526B2

(12) United States Patent
Mosier et al.

(10) Patent No.: US 7,384,526 B2
(45) Date of Patent: Jun. 10, 2008

(54) HIGH-PRESSURE MICROHYDRAULIC ACTUATOR

(75) Inventors: Bruce P. Mosier, San Francisco, CA (US); Robert W. Crocker, Fremont, CA (US); Kamlesh D. Patel, Dublin, CA (US)

(73) Assignee: Sandia Corporation, Livermore, CA (US)

( * ) Notice: Subject to any disclaimer, the term of this patent is extended or adjusted under 35 U.S.C. 154(b) by 687 days.

(21) Appl. No.: 10/848,201

(22) Filed: May 17, 2004

(65) Prior Publication Data

US 2005/0252776 A1 Nov. 17, 2005

(51) Int. Cl.
*G01N 27/453* (2006.01)
*B01L 3/02* (2006.01)

(52) U.S. Cl. ..... 204/600; 422/100

(58) Field of Classification Search ..... 422/100; 204/600

See application file for complete search history.

(56) References Cited

U.S. PATENT DOCUMENTS

| | | | | |
|---|---|---|---|---|
| 6,224,775 | B1 * | 5/2001 | Foley et al. | 210/635 |
| 6,277,257 | B1 * | 8/2001 | Paul et al. | 204/450 |
| 6,472,443 | B1 * | 10/2002 | Shepodd | 521/63 |
| 2004/0074768 | A1 * | 4/2004 | Anex et al. | 204/294 |
| 2004/0074784 | A1 | 4/2004 | Anex et al. | 205/674 |
| 2006/0160205 | A1 * | 7/2006 | Blackburn et al. | 435/287.2 |

OTHER PUBLICATIONS

Mosier, Bruce P.; Robert W. Crocker; Kamlesh D. Patel; High-pressure microhydraulic actuator; Nov. 15-21, 2003; ASME; Proceedings of IMECE '03; 2003 ASME International Mechanical Engineering Conference and Exposition; pp. 1-6.*

Yao, Shuhuai; David Huber; James C. Mikkelsen; Juan G. Santiago; A large flowrate electroosmotic pump with micron pores; Nov. 11-16, 2001; ASME; Proceedings of 2001 ASME International Mechanical Engineering Congress and Exposition; vol. 3; pp. 639-645.*

Reichmuth, David S.; Gabriela S. Chirica; Brian J. Kirby; Jan. 14, 2003; Elsevier; Sensors and Actuators; vol. 92; pp. 37-43.*

Reichmuth, D.S.; Chirica, Gabriela; and Kirby, B.J.; "Increasing the performance of high-pressure, high-efficiency electrokinetic micropumps using zwitterionic solute additives" *Sensors and Actuators B*, v. 92 2003; pp. 37-43.

(Continued)

*Primary Examiner*—Alex Noguerola
(74) *Attorney, Agent, or Firm*—Timothy P. Evans

(57) ABSTRACT

Electrokinetic ("EK") pumps convert electric to mechanical work when an electric field exerts a body force on ions in the Debye layer of a fluid in a packed bed, which then viscously drags the fluid. Porous silica and polymer monoliths (2.5-mm O.D., and 6-mm to 10-mm length) having a narrow pore size distribution have been developed that are capable of large pressure gradients (250-500 psi/mm) when large electric fields (1000-1500 V/cm) are applied. Flowrates up to 200 μL/min and delivery pressures up to 1200 psi have been demonstrated. Forces up to 5 lb-force at 0.5 mm/s (12 mW) have been demonstrated with a battery-powered DC-DC converter. Hydraulic power of 17 mW (900 psi@ 180 uL/min) has been demonstrated with wall-powered high voltage supplies. The force and stroke delivered by an actuator utilizing an EK pump are shown to exceed the output of solenoids, stepper motors, and DC motors of similar size, despite the low thermodynamic efficiency.

11 Claims, 8 Drawing Sheets

OTHER PUBLICATIONS

Mosier, B.P.; Crocker, R.W.; Patel, K.D.; Rognlien, J.L.; "High-Pressure Microhydraulic Actuator" Proceedings of IMECE'03; 2003 ASME International Mechanical Engineering Conference and Exposition; Nov. 15-21, 2003 Washington, D.C.; IMECE2003-44401, 6 pp.

Ngola, S.M.; Fintschenko, Y.; Choi, W.-Y.; and Shepodd, T.J.; "Conduct-as-Cast Polymer Monoliths as a Separation Media for Capillary Electrochromatography" *Analytical Chemistry*, v.73(5), Mar. 1, 2001; pp. 849-856.

Yao, S.; Huber, D.; Mikkelsen, J.C.; and Santiago, J.G; "A Large Flowrate Electroosmotic Pump With Micron Pores" Proceedings of IMECE; 2001 ASME International Mechanical Engineering Conference and Exposition; Nov. 11-16, 2003 New York, NY MEMS v.3 IMECE2001/MEMS-23890, pp. 639-645.

Svec, F.; Peters, E.C.; Sýkora, D.; and Fréchet, J.M.J.; "Design of the monolithic polymers used in capillary electrochromatography columns" *Journal of Chromatography A*, v.887, 2000; pp. 3-29.

Paul, P.H.; "Electrokinetic Pumps and Actuators"; Sandia Report SAND 2000-8218; Mar. 2000; 30 pp.

Paul, P.H.; "Microfluidic Engineering"; Sandia Report SAND 99-8212; Dec. 1998; 22 pp.

* cited by examiner

HIGH-PRESSURE MICROHYDRAULIC ACTUATOR

STATEMENT OF GOVERNMENT INTEREST

This invention was made with Government support under government contract DE-AC04-94AL85000 awarded by the U.S. Department of Energy to Sandia Corporation. The Government has certain rights in the invention, including a paid-up license and the right, in limited circumstances, to require the owner of any patent issuing in this invention to license others on reasonable terms.

TECHNICAL FIELD

The present invention relates to an embodiment comprising a miniature microfluidic transducer, and particularly to an actuator driven by an electrokinetic pump, wherein the hydraulic pressure is used to drive a piston or bellows.

BACKGROUND

Miniature pumps and valves have been a topic of increasing interest in recent years within the field of chemical analysis, especially in those applications where a variety of functions including pumping, mixing, metering, and species separation are necessary. In particular, there has been interest in integrating miniature pumps and valves with silicon and glass chip-based analysis systems designed to detect and identify trace amounts of chemical or biological material.

To meet these needs efforts have been made to develop and refine micro-scale pumps that rely on the well-known electroosmotic effect, so-called electrokinetic ("EK") pumps, and related control and valving mechanisms for these devices. The phenomenon of electroosmosis, in which the application of an electric field to an electrolyte in contact with a dielectric surface produces a net force on a fluid and thus a net flow of fluid, has been known since the nineteenth century. The physics and mathematics defining electroosmosis and the associated phenomenon of streaming potential have been extensively explored in "Introduction to Electrochemistry," by Glasstone, (1942) pp. 521-529 and by Rastogi, (*J. Sci. and Industrial Res*., v. 28, (1969) p. 284). In like manner, electrophoresis, the movement of charged particles through a stationary medium under the influence of an electric field, has been extensively studied and employed in the separation and purification arts.

The use of electroosmotic flow for fluid transport in packed-bed capillary chromatography was first documented by Pretorius, et. al. (*J. Chromatography*, v. 99, (1974) pp. 23-30). Although the possibility of using this phenomenon for fluid transport has long been recognized, its application to perform useful mechanical work has been addressed only indirectly. The present embodiment describes an actuator using an EK pump to drive a piston to perform mechanical work.

EK pumps are typically composed of a nanoporous packing or monolith (pore diameters from 10 to 500 nm) and a pair of high-voltage electrodes. For example, silica acquires a negative surface charge composed of deprotonated silanol groups ($SiOH \Leftrightarrow SiO^- + H^+$) when an electrolyte with pH>4 is introduced. As illustrated in FIG. 1, a thin electric double-layer (10 nm for water with 1 mM NaCl) is known to develop adjacent to the walls of such devices. Application of an electric field exerts a body force on ions residing within the double layer and results in ion migration in the direction of the electric field gradient which induces viscous "drag" in the bulk fluid. Adding a flow restriction downstream of the porous EK pump monolith will result in an opposing pressure gradient. Hydraulic work, therefore, may be obtained after the fluid exits the porous EK pump monolith. The pressure-driven flow may be used for various applications, such as flow work against a capillary restriction, driving a piston, expanding a bellows, or fluid compression.

Conversely, external pressure-driven flows in these systems will generate electric fields that may be used to perform electrical work.

Many different microfluidic transducers have been implemented by micromachining of silicon and glass substrates. Transducers with pneumatic, thermo-pneumatic, piezoelectric, thermal-electric, shape memory alloy, and a variety of other actuation mechanisms have been realized with this technology. However, only the thermo-pneumatic and shape memory alloy designs have been incorporated in commercially-available products. Unfortunately, transducers utilizing the aforementioned actuation mechanisms are only able to generate modest actuation pressures and are therefore of limited utility.

What is needed is a transducer that can be used for microfluidic systems that can exert larger actuation pressures over longer distances (i.e., more work per stroke) than can be presently developed by conventional (non-explosive) transducers and provides both rapid "on" and "off" actuation.

SUMMARY

EK pumps are known to exhibit a linear pressure flowrate operating envelope for a given electric field. This linearity is due to the linearity of superposing linear electroosmotic and pressure-driven flows (ignoring property changes due to viscous heating or electrolyte composition). Because hydraulic power is the product of pressure and flowrate, the most efficient operating point for a given electric field is half the maximum pressure and half the maximum flowrate. The maximum power output increases linearly with electric field up to the point where property changes occur. For example, viscous heating at high electric fields decreases the viscosity which, in turn, increases the current draw and the power output.

Our prior efforts have demonstrated electrokinetic pumps in glass capillaries (100 μm I.D./360 μm O.D., length 3-cm to 30-cm) that are capable of pressure gradients of 250-500 psi/mm and average fluid velocities of 2 mm/s. The present embodiment describes advances in EK pump fabrication for developing larger diameter porous monoliths and their application to mechanisms for performing mechanical work. In particular, the pumps described herein have been fabricated with diameters of 2.9-mm, and lengths from 6-mm to 10-mm. Moreover, while these pumps produce pressure gradients that are similar to those of their smaller diameter counterparts, they also produce much larger flowrates, e.g., 200 μL/min for the present embodiments vs. 5 μL/min for prior-art EK pumps.

The force and stroke (i.e., work per stroke) delivered by the EK actuators of the present embodiments exceed the output of solenoids, stepper motors, and DC motors of similar size, despite the low electric-to-hydraulic power conversion efficiency of EK pumps (1-6%). Piezoelectric actuators of similar size can deliver much larger forces (e.g., 200 lbf), but their displacements are very small (e.g., 50 μm). The pump and electrodes contain no moving parts and operate silently, which is beneficial for applications requiring actuation with low noise and vibration levels.

The objective of the present invention is to provide a robust microfluidic actuator device utilizing hydraulic fluid pressures generated by electroosmotic flows.

Another objective of this invention is to provide a microfluidic actuator operable as a linear actuator.

These and other objectives and advantages of the present invention may be clearly understood from the detailed description by referring to the following drawings.

DETAILED DESCRIPTION OF THE EMBODIMENTS

Figure 1:
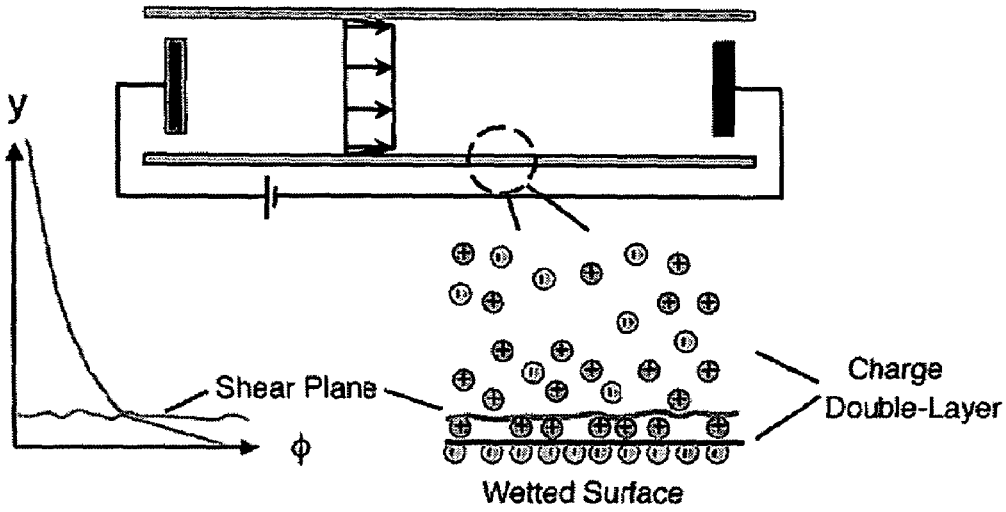
FIG. 1 shows a schematic of the charge double layer that develops due to an electrolyte and wall interaction.

Optimum efficiency for an EK pump, as described by Paul (Sandia National Laboratories Reports SAND99-8212 "Microfluidic Engineering" December, 1998; and SAND00-8218 "Electrokinetic pumps and Actuators" March, 2000; and U.S. Pat. Nos. 6,019,882 and 6,013,164), is achieved when a single pore size is present. Moreover, an optimal pore size exists for a particular electrolyte and material combination. Pores smaller than twice the double layer thickness carry current without dragging appreciable volumes of liquid and result in a low flowrate-to-current ratio while pores larger than twice the double-layer thickness do not provide sufficient pressure-driven flow resistance, i.e., they are too permeable.

Electroosmotic flow is not an efficient method of converting electrical work to mechanical work because the mechanism is based on viscous coupling of ion motion to fluid motion in the nanometer-scale electric double layer, which results in high shear stress and corresponding viscous dissipation. EK pumps are therefore inefficient (the pumps of the present embodiment have demonstrated efficiencies between about 1% and about 6%) and draw substantial current densities when large electric fields are applied (e.g. 100 mA/cm$^2$ for 1000 V/cm). Moreover, for capillary EK pumps with 0.1-mm O.D. porous monoliths, typical currents of 5-10 μA result in current densities at the electrode surface that are insufficient to nucleate bubbles (for 0.38-mm-diameter platinum wires), and the electrolysis gases simply dissolve into solution. However, increasing the pump cross-section to a diameter of 2.5-mm results in currents up to 3 mA, which is sufficient to generate visible bubble growth in a few seconds. These gas bubbles cause the current to fluctuate and decrease to a trivial magnitude (nonzero due to water films around the bubbles). Hence, gas bubble-free electrodes are necessary for stable long-term operation.

Described herein are various embodiments of microhydraulic actuators comprising millimeter-scale porous monoliths. In particular, the microhydraulic actuators of these embodiments were designed to use either polymer or glass porous monoliths. Moreover, both porous monolith configurations were designed to provide a pore size range of about 50 nm to about 100 nm.

The broad method for fabricating of porous polymers for electrokinetic transport, for capillary and chip-based electrochromatography, and for mobile monolith valves has been described previously. Typically, solvents, monomers, and initiators are combined and cured thermally or with ultraviolet light.

Fabrication of the Polymer Monoliths:

Porous polymers offer the advantages of rapid fabrication, tunable pore size distribution, and a broad useful pH range (e.g. pH 2 through pH 12). Polymer monoliths may be provided in generally any useful size provided at least one dimension is less than about a few centimeters across to allow for uniform and consistent curing. Because it is known that pore size distribution is strongly affected by the relative concentration of the mixture constituents, a modified recipe, based on the work of Shepodd, et al., (*Analytical Chemistry*, v. 73 (5) (2001), pp. 3-29) and herein incorporated by reference, was provided by varying the solvent and charge carrier composition to target an average pore size range of between about 50 nm to about 100 nm.

A general process for providing a polymer monolith EK pump is as follows:

1. providing purified monomers;
2. mixing the monomers, a chosen solvent, and an initiator material;
3. curing the mixture with UV light or by heating at 60° C. to provide a cured monolith;
4. extracting residual monomers from the cured monolith with supercritical $CO_2$ or another similar solvent agent compatible with the cured monolith;
5. encasing the cured monolith with a fluid-tight seal; and
6. grinding and sanding the ends of the sealed monolith assembly until a full cross-section of monolith appears.

The solvent mixture used in the present embodiment was composed of the following spectroscopy-grade materials (unless otherwise specified all materials were obtained from Aldrich Chemical Company Inc., Milwaukee, Wis.).

The solvent solution is comprised of 1.74 mL of acetonitrile, together with 0.54 mL of ethanol, and 0.40 mL of 5 mM phosphate buffer at a pH 6.8. The methacrylate monomer mixture was comprised of: 330 μL ethylene glycol dimethacrylate ("EGDma"), 435 μL butyl methacrylate ("Bma"), 530 μL tetrahydrofurfuryl methacrylate ("THFma"), and 5 μL methacryloyloxyethyl trimethylammonium methyl sulfate ("MOEma") 80% in water. In addition, all monomers were purified by solid phase extraction through aluminum oxide and silica sand to remove methyl hydroquinone inhibitors.

The monomers and solvents were mixed together first, and then adding 5 mg of IRGACURE® 1800 (Ciba Specialty Chemicals North America, Tarrytown, N.Y.), an ultraviolet ("UV") initiator. This mixture was further mixed in a high-speed vortex mixer, briefly degassed by vacuum, and finally removed by pipette into several 3" long segments of ⅛" I.D., ¼" O.D. translucent Fluorinated ethylene propylene ("FEP") tubing (Berghof/America, a division of Jensen Inert Products, Inc., Coral Springs Fla.) capped at one end with a silicone rubber SUBA-SEAL® septa, obtained from Aldrich Chemical Company, Inc. The other end of the tube is capped and the apparatus is placed inside a XL-1500 SPECTROLINKER UV oven (Spectronics Corp., Westbury, N.Y.) operating at full power for 30 minutes to polymerize the mixture. The cured monolith is then pushed out of the tubing and stored overnight in a vial of methanol to dilute the residual uncured solvent mixture and avoid drying.

Figure 2A:
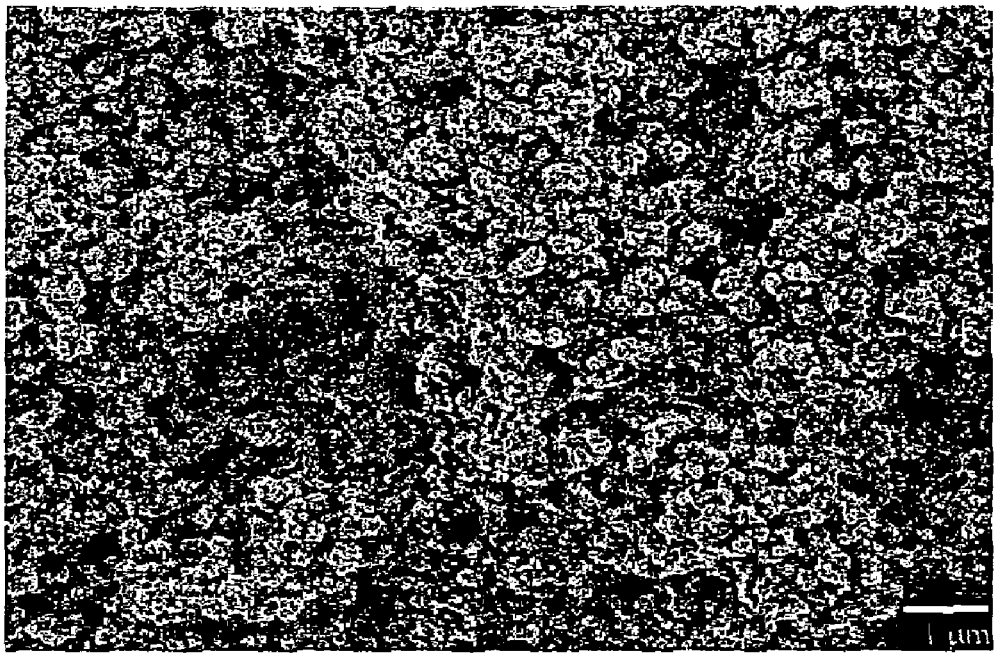
FIG. 2A shows an SEM photomicrograph of an interior fracture surface of a porous methacrylate monolith.

Finally, because drying the monolith in air results in stresses that are sufficient to cause it to fracture into millimeter-size pieces, the residual uncured solvent mixture contained within the monolith interstices is extracted with supercritical $CO_2$ using a SFX 220 supercritical fluid extractor obtained from ISCO, Inc., Lincoln, Nebr. After extraction and drying, the diameter of the polymer monolith is found to decrease by about 20%: from about 3.4-mm (methanol solvent) to about 2.7-mm. A SEM image of a fresh fracture surface of the extracted polymer is shown in FIG. 2A.

Once dried, the monolith is encapsulated inside the interior diameter of a standard ¼-28 threaded polyether-ether-ketone (PEEK) flangeless fitting obtained from UPCHURCH SCIENTIFIC, Inc., Oak Harbor, Wash. For this application the knurled head of the fitting is removed, both ends flanged, and the fitting interior diameter is internally threaded with a 6-32 drill tap to provide added support for sealing the polymer monolith into the nut interior. Encapsulation is performed by drawing a quantity of an epoxy sealant (SCOTCH-WELD® DP-420 black) obtained from the 3M Company, St. Paul, Minn., into a 3-mL syringe, connecting the syringe to the nut interior, and the epoxy slowly injected until the nut interior is completely filled. The monolith is also coated with a layer of the sealant and then inserted into the nut interior and held in place until the epoxy stops flowing (30 seconds). After allowing this assembly to air-cure for an hour at 49° C., the cylinder faces are ground flat with a hand-held grinding wheel or some similar device until the full cross-section of the polymer monolith is visible on both ends.

Fabrication of Silica Monoliths:

The basic fabrication process for providing a silica monolith for an EK pump is as follows:

1. silica beads fabricated by the Stöber process (*Journal of Colloid and Interface Science*, v. 26 (1) (1968) pp. 256-264, herein incorporated by reference) or purchased from a commercial vendor such as Duke Scientific or Bangs Labs are provided;
2. the silica beads are suspended by sonication in dilute aqueous solution of ammonium hydroxide (pH 9-10);
3. slurry packing a stainless steel tube at approximate flowrate of 0.5 mL/min by raising pressure to about 30,000 psi;
4. removing packing tube and dry at 90° C. for 3 hours;
5. sintering for 90 minutes at 1050° C.;
6. hydroxylate in 2.5 M NaOH for 5 minutes at 60° C.;
7. encasing monolith with epoxy inside a rigid plastic tube; and
8. grinding and sanding ends flat until full cross-section of monolith appears.

Figure 3:
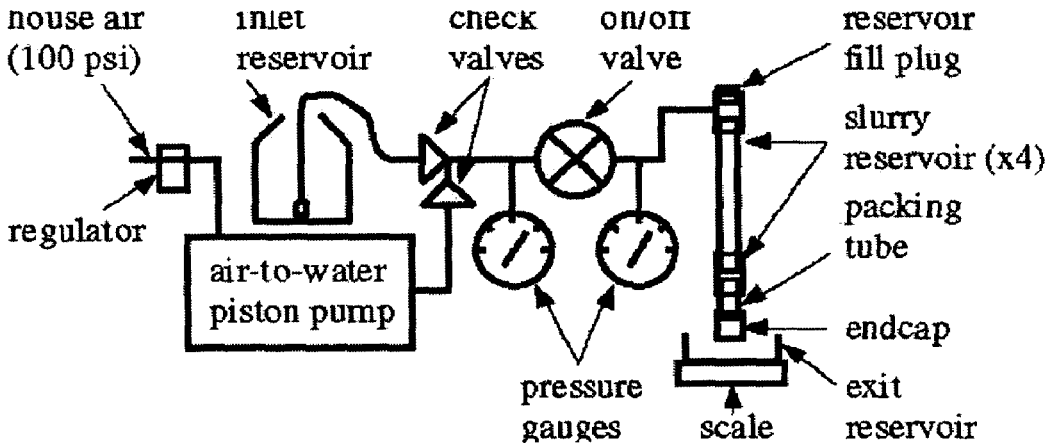
FIG. 3 shows a schematic of the pressure-driven slurry-packing apparatus used to prepare the silica monolith green form.

Slurry packing of 0.5 μm silica beads was performed with a simple pressure-driven system as illustrated in FIG. 3. A slurry composed of 1% silica beads by weight suspended in dilute ammonium hydroxide (pH 9-10) was produced by sonication and mechanical agitation. The slurry reservoir was a 23-mL reservoir composed of four (4) 12" stainless steel tubes with 3/16" I.D. pressure rated for liquids to 60 ksi and obtained from the High Pressure Equipment Company, Erie, Pa. The slurry was loaded into the reservoir by inserting a long polyimide-coated silica capillary (0.5-mm I.D./0.65-mm O.D.), purchased from Polymicro Technologies, LLC, Phoenix, Ariz., into the stainless steel tubing and forcing the slurry through the capillary with a 20-mL syringe. A manual syringe pump provided by the High Pressure Equipment Company, Erie, Pa., was used to pressurize the fluid to 6,000 psi, after which an air-to-water piston pump provided by Haskel International, Burbank, Calif., was used to automatically maintain constant pressure. The pressure was gradually raised to maintain 0.5 mL/min of flowrate until 30 μL had been displaced. The pressure was then raised to 45 ksi to flush the bed with deionized water until the pH of the water flushed through the silica bed was found to be between 7 and 7.5 (typically requires about an additional 30 to 50 mL of water). Air was bled from the piston pump and the syringe pump was used to bleed the pressure to within 20 psi of ambient atmospheric pressure. The fitting at the top of the reservoir was opened and the fitting holding the packing tube was loosened to allow fluid in the reservoir to drain through the leak-check ports in the union. The fluid remaining in the packing tube was removed with a syringe needle. The packing tube was removed from the end cap, then dried for 90 minutes at 90° C. to provide the green silica form.

Figure 2B:
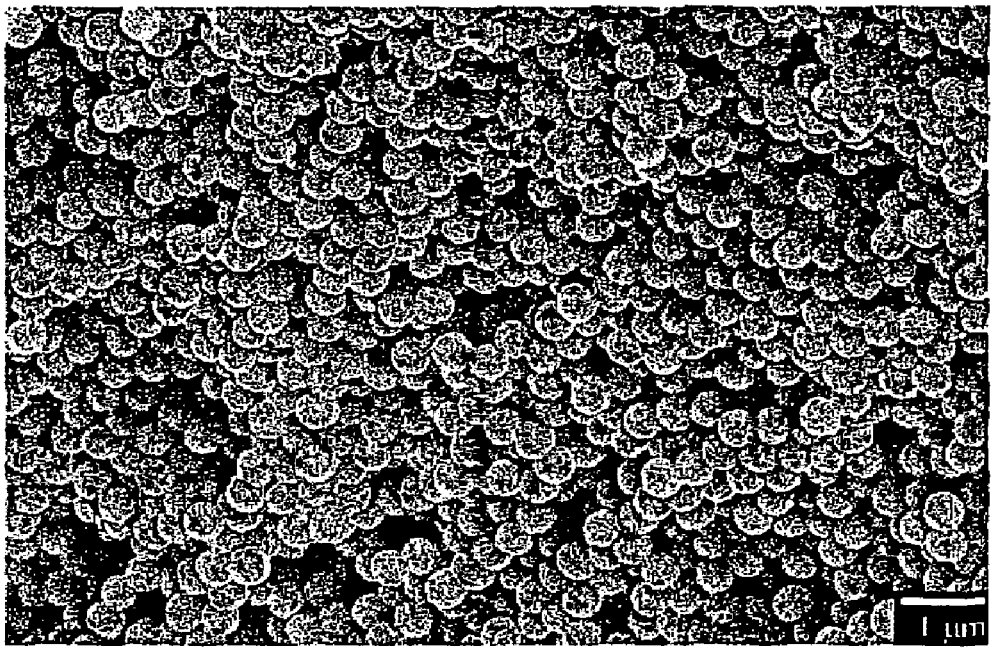
FIG. 2B shows an SEM photomicrograph of an interior fracture surface of slurry packed 0.5-μm silica beads that have been sintered to form a silica monolith.

Sintering of the green body is accomplished by heating the green form in an air furnace at a rate of about 5° C./min up to 1050° C. The packed silica body is held at this temperature for an additional 90 minutes and then cooled to room temperature at a rate of about 10° C./min. This process forms a monolith having an average post-sinter density of 67% and having a closed-packed pore size range of between about 50 nm to about 100 nm. FIG. 2B shows an interior fracture surface of the sintered silica monolith showing the initially 0.5-μm diameter silica beads generally remain intact thereby providing an equivalent close-packed pore size of about 70-nm.

The high temperatures used during the sintering process, however, form strained siloxane bridges between beads thus reducing the number of free silanol groups and hence the zeta potential of the bed interior surface in an aqueous solution. To correct this problem, the silica monoliths of the present embodiments were soaked in a warm, concentrated solution of sodium hydroxide (2.5 M NaOH for 5 minutes at 60° C.) in order to hydroxylate the monolith-free surface. The sodium hydroxide solution removes a few nanometers of the bead surface, exposing native silica and increasing the bulk zeta potential.

The sinter silica monolith is mounted just as the polymer monolith is mounted, i.e., by inserting the structure into a modified PEEK fitting and sealing it in place with an epoxy sealant except that curing the epoxy is left to dry overnight at room temperature and is then cured at 96° C. for an hour. The epoxy penetrates the monolith to a depth of 100 μm.

Figure 4:
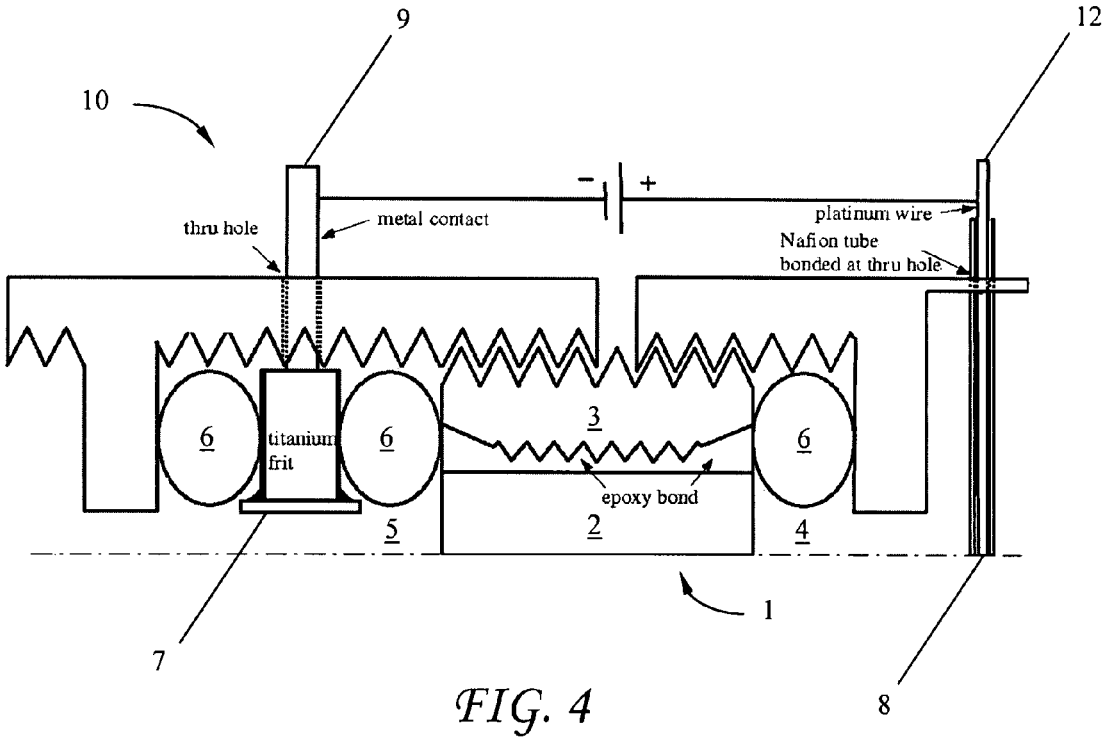
FIG. 4 shows a cross-sectional cut away of the actuator pump/electrode housing assembly.
Figure 5A:
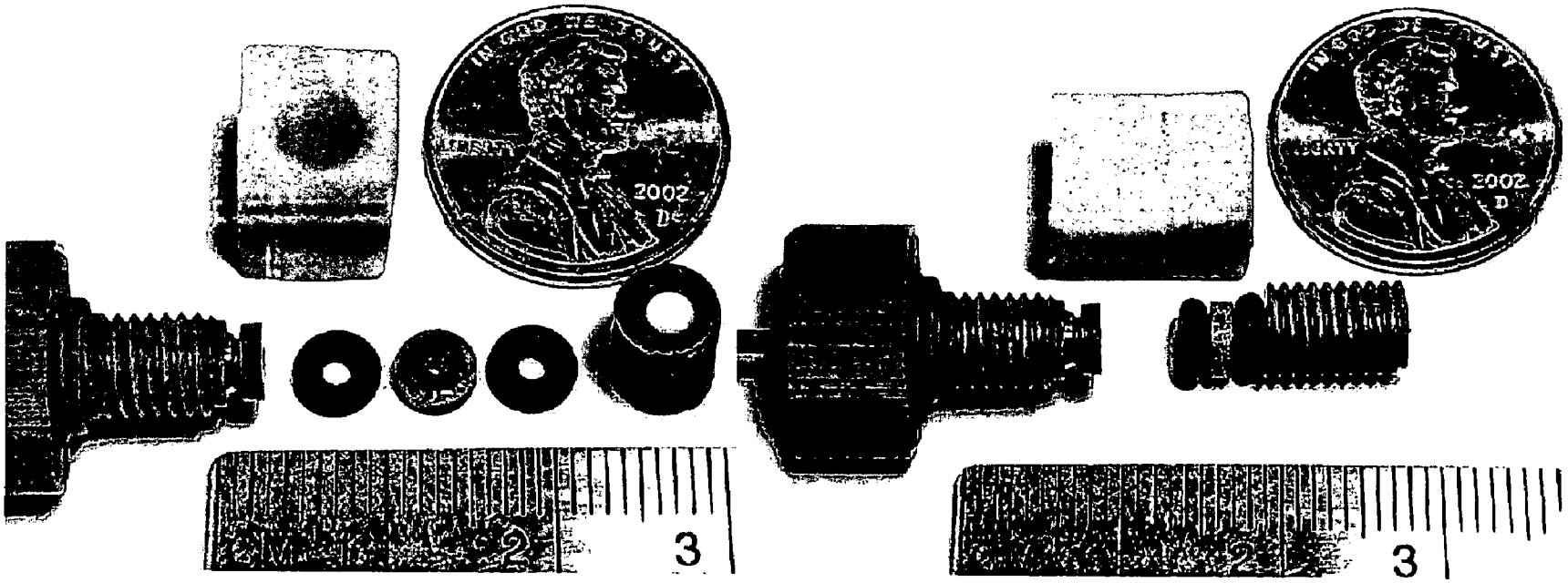
FIG. 5A shows close-up exploded and partially assembled views of the encapsulated actuator pump and electrodes.
Figure 5B:
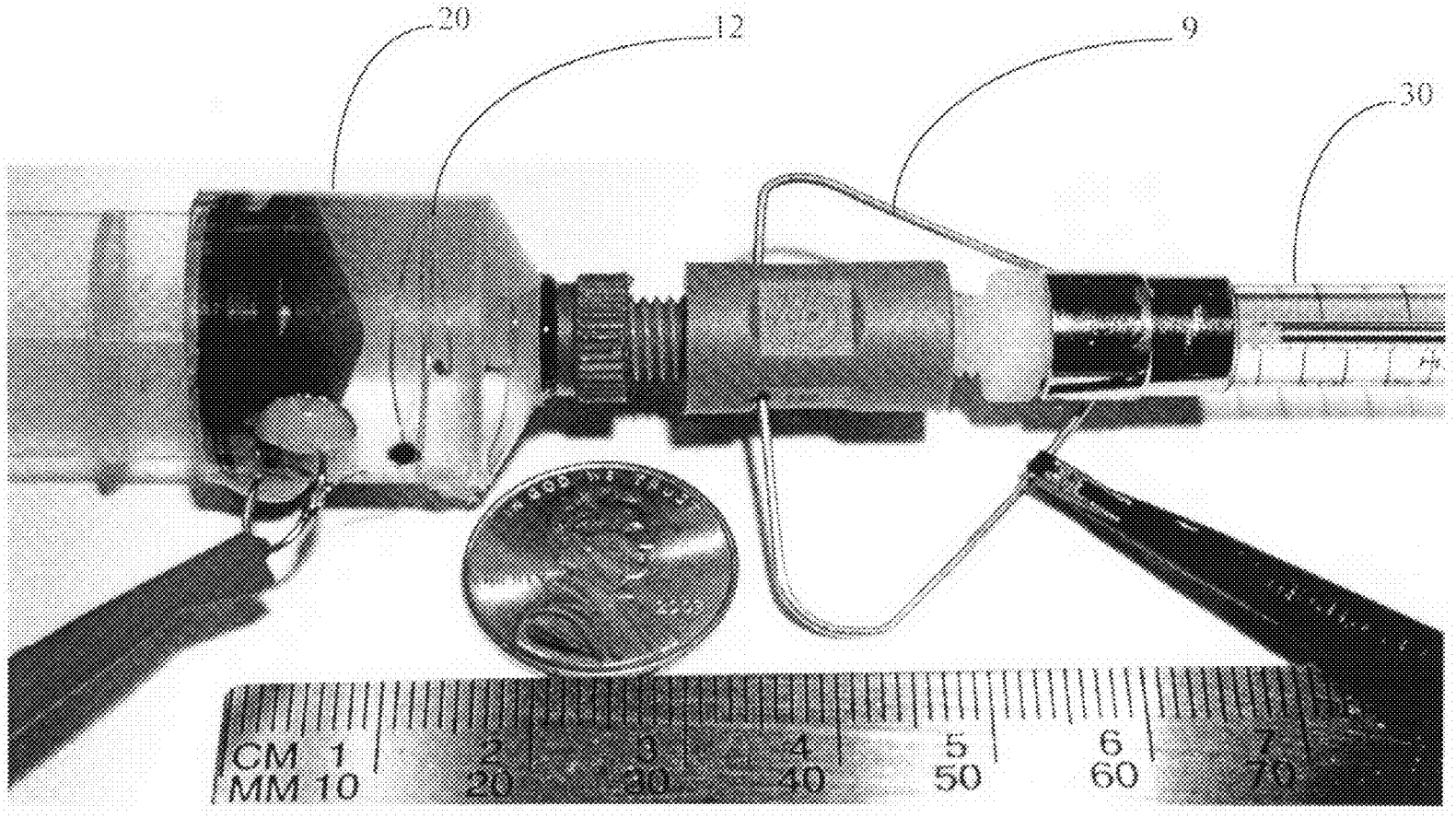
FIG. 5B shows a close-up side view of the assembled actuator.
Figure 5C:
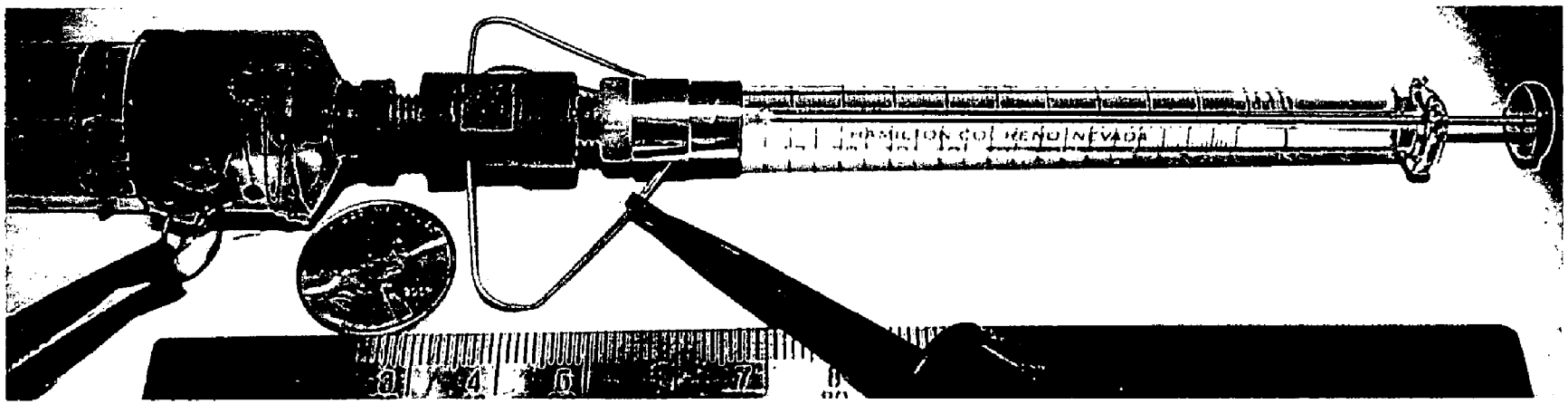
FIG. 5C shows an overall view of the assembled actuator of the present invention.

Examples of the Actuator:

A cut away of the present embodiment of EK pump/electrode assembly 10 is shown in FIG. 4. The actuator comprises EK pump 1, itself comprised of porous media 2 mounted in housing 3, rubber O-rings 6 for connecting and containing pump 1 and electrodes 7 and 8 so as to provide respective inlet and outlet ends 4 and 5, and leads 9 and 12. The assembled prototype actuator, shown in FIGS. 5B and 5C, has a source of an electrolyte (not shown), contained within liquid-tight housing 20 and liquid-tight cylinder and piston assembly 30 comprising a 100 μL syringe with a 1.4-mm diameter plunger attached to the outlet side of the EK pump. Syringes with a larger plunger area may be used to achieve proportionally larger forces but smaller velocities.

Figure 6:
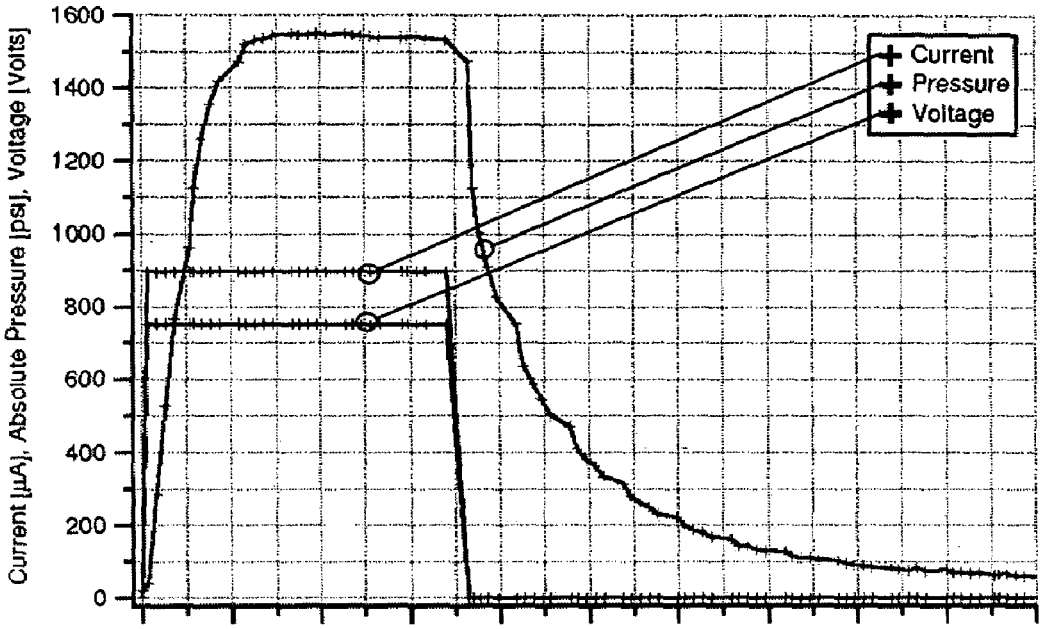
FIG. 6 shows the transient pressure response of an actuator of the present embodiment using a silica monolith EK pump at an electric field strength of 100 V/cm.

As an example, FIG. 6 shows the speed with which the pressure may be increased. The transient time is determined by the volume displaced during static system loading over the same pressure range. The actuator must displace that volume of liquid before steady state is achieved. In this example, the total volume displaced can be estimated by assuming a linear pressure rise to 1500 psi and an unrestricted EK pump flowrate of 100 μL/min for the given electric field strength (based on other experiments at partial load conditions and assuming linearity). The resulting displacement is 0.8 μL, i.e., 0.8 $mm^3$, which seems reasonable given the syringe plunger isolator and the possibility that the isolator had a small bubble.

Figure 7:
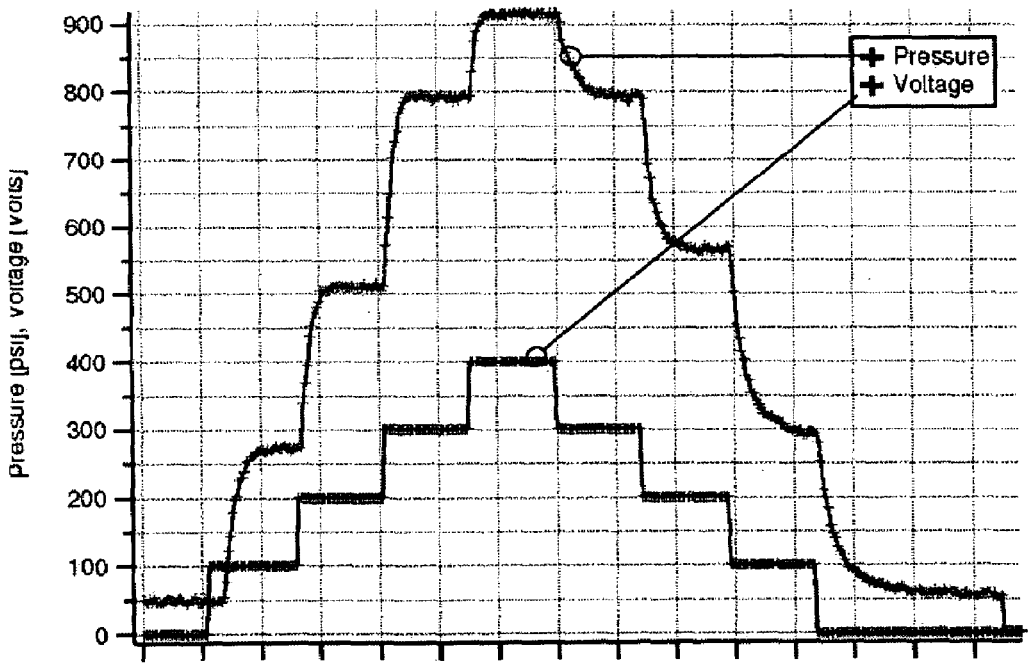
FIG. 7 shows the transient pressure response of an actuator comprising a silica monolith EK pump with a closed exit and a syringe plunger isolator present that does not permit the pressure to drop below 50 psi.

FIG. 7 shows the transient pressure response to step changes in electric field for an actuator comprising a silica monolith EK pump with a closed exit. The pump fluid is 5-mM TRIS with 1.25-mM 4-(2-hydroxyethyl)-1-piperazineethanesulfonic acid (HEPES) at pH 8. The apparent thermodynamic efficient, $\eta_{max}$, is 2.5 for the first three voltage steps and decreases to 2.3 for higher field strengths because there is a small leak at high pressure. The transients for each voltage step take 5 to 7 seconds to reach steady-state due to system compressibility.

Figure 8:
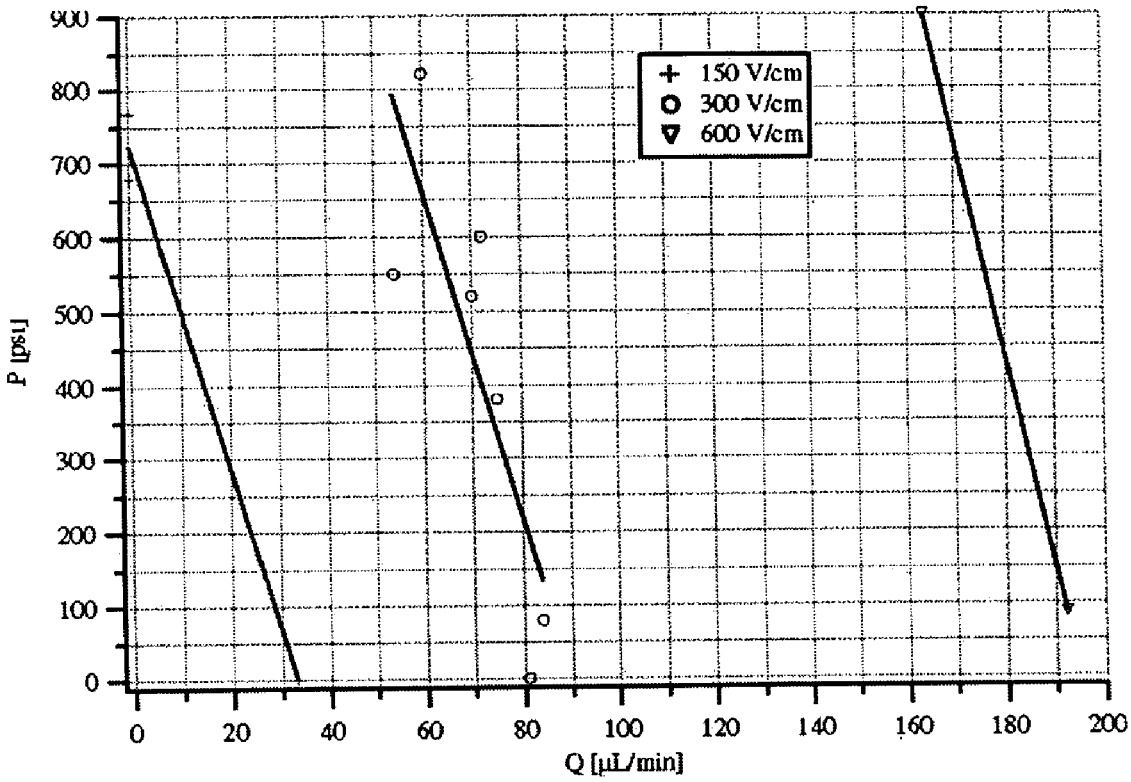
FIG. 8 shows the performance of the actuator of the present embodiment using a silica monolith EK pump operating at 8 psi/V at electric field strengths of 150, 300, and 600 V/cm.

FIG. 8 shows the performance for an actuator capable of producing 8 psi/Volt (55 kPa/v). The partial load conditions were observed using masses on a syringe plunger to maintain constant pressure during 15 to 60 seconds of piston displacement to measure the flowrate. Pressures above 900 psi (6.2 MPa) were not measured due to seal limitations of early designs. A pressure of 900 psi (6.2 MPa) at the actuator face corresponds to 6.3 lbf (28 N) distributed along the monolith. The observed $\eta_{max}$ decreases slightly above 500 psi (3.4 MPa), presumably due to small leaks past the O-ring on the outlet side of the EK actuator, although no visible leaks were seen during the experiments. A least-squares fit of the data for constant field strength, show a non-linear rise in y-intercept, i.e., higher $\eta_{max}$, due to pump heating that lowers the viscosity and allows more current for a given field strength.

High-pressure microhydraulic actuation, therefore, has been demonstrated with gas bubble-free electrodes, an EK pump, and syringes with different plunger areas. Using the prototype actuator shown in FIG. 5C, several 1-mm thick glass microscope slides (25-mm×76-mm) were fractured in 3-point bending with a 3.3-mm diameter piston driven at 530 psi (3.7 MPa), corresponding to a output force of 7 lbf (31.1 N). The current and voltage were 2 mA at 1500 V. Silica EK pumps have demonstrated flowrates and pressures of 200 μL/min at 400 psi (2.75 MPa) and 100 μL/min at 1000 psi (6.9 MPa) for driving loads of 2.1 and 5.3 lbf (9.3 and 23.6 N) at velocities of 1 mm/s and 0.5 mm/s, respectively, with a 2.2-mm diameter piston. Long-stroke actuation has been demonstrated by lifting 2 lbf (8.9 N) at 1 mm/s over 7-cm using a 100-μL syringe. Hydraulic power up to 17 mW has been demonstrated by an 8-psi/volt (55 kPa/V) pump delivering 164 μL/min at 900 psi (6.2 MPa). These forces and strokes exceed the work-per-stroke output of solenoids, stepper motors, and DC motors of similar size. Piezoelectric actuators of similar size can deliver much larger forces (200 lbf), but their displacements are very small (50 μm). The pump and electrodes contain no moving parts and operate silently, which is beneficial for applications requiring actuation with low noise and vibration levels.

High-pressure microhydraulic actuation driven by millimeter-scale electrokinetic pumps with gas-bubble-free electrodes has been demonstrated. High performance porous polymer and sintered silica monoliths have been developed that give 1% and 3% electric.

What is claimed is:

1. An actuator, comprising:

a conduit having a length, an interior cross-section, and first and second ends;

a porous sintered body, comprising a plurality of packed insulating particles and a plurality of interstices between said insulating particles, said porous sintered body disposed within said conduit spanning said interior cross-section;

a movable piston having a stroke length of up to 7 centimeters fixedly joined to said conduit second end;

a fluid reservoir in communication with said conduit first end, said fluid reservoir containing a quantity of a conducting fluid media, said conducting fluid media filling first and second ends of said conduit, said plurality of interstices, and a void space ahead of said movable piston, wherein said fluid acts against a moveable outward facing surface of said movable piston;

a first electrode disposed in said conduit first end proximate said porous sintered body, and a second electrode disposed in said conduit second end proximate said porous sintered body; and power supply means for applying a potential between said first and second electrodes.

2. The actuator of claim 1, wherein the porous sintered body comprises a plurality of silica particles.

3. The actuator of claim 2, wherein the silica particles comprise 0.5-μm diameter silica beads.

4. The actuator of claim 2, wherein the silica particles are sintered at a temperature of about 1050° C. for about 90 minutes and then cooled to provide a sintered silica monolith.

5. The actuator of claim 4, wherein the sintered silica monolith is soaked in a concentrated aqueous solution of sodium hydroxide for about 5 minutes.

6. The actuator of claim 1, wherein the movable piston generates an output force of least about 7 lbf.

7. The actuator of claim 6, wherein the movable piston comprises a cylinder-piston assembly.

8. The actuator of claim 6, wherein the movable piston further includes a spring assembly, wherein said spring assembly operates against the actuation pressure of the fluid.

9. The actuator of claim 8, wherein the movable piston is reciprocating.

10. The actuator of claim 1, wherein the fluid is an aqueous solution comprising 5-mM Tris(hydroxymethyl) aminomethane (TRIS) with 1.25-mM 4-(2-hydroxyethyl)-I-piperazineethanesulfonic acid (HEPES) at a pH of about 8.

11. The actuator of claim 1, wherein the movable piston has a response time of about 5 to 7 seconds to reach equilibrium.

* * * * *